US008025245B2

(12) United States Patent
Truan et al.

(10) Patent No.: US 8,025,245 B2
(45) Date of Patent: Sep. 27, 2011

(54) MATERIAL SPREADER WITH INTEGRATED WETTING SYSTEM

(75) Inventors: Charles J. Truan, Bloomfield Hills, MI (US); James Truan, Royal Oak, MI (US); Joshua Scott, Troy, MI (US); Paul Mandrik, Clinton Township, MI (US)

(73) Assignee: Trynex, Inc., Warren, MI (US)

( * ) Notice: Subject to any disclaimer, the term of this patent is extended or adjusted under 35 U.S.C. 154(b) by 141 days.

(21) Appl. No.: 12/177,955

(22) Filed: Jul. 23, 2008

(65) Prior Publication Data

US 2009/0032624 A1 Feb. 5, 2009

Related U.S. Application Data

(60) Provisional application No. 60/951,286, filed on Jul. 23, 2007.

(51) Int. Cl.

| | |
|---|---|
| ***A01C 23/00*** | (2006.01) |
| *A01C 3/06* | (2006.01) |
| *A01C 7/08* | (2006.01) |
| *A01C 15/00* | (2006.01) |

(52) U.S. Cl. ..... 239/662; 239/650; 239/653; 239/658; 239/672; 239/675

(58) Field of Classification Search ..... 239/650, 239/622, 146, 172

See application file for complete search history.

(56) References Cited

U.S. PATENT DOCUMENTS

| | | | | |
|---|---|---|---|---|
| 3,019,470 | A * | 2/1962 | Romeo | 401/36 |
| 4,029,237 | A | 6/1977 | Miconi | |
| 4,442,979 | A | 4/1984 | Kupper | |
| 5,267,696 | A * | 12/1993 | Balmer | 239/662 |
| 5,904,296 | A * | 5/1999 | Doherty et al. | 239/61 |
| 5,931,393 | A * | 8/1999 | Alsip et al. | 239/654 |
| 6,394,735 | B2 * | 5/2002 | Hollinrake et al. | 414/519 |
| 6,446,879 | B1 * | 9/2002 | Kime | 239/7 |
| 7,147,583 | B2 * | 12/2006 | Lemanski | 475/164 |
| 7,275,700 | B2 * | 10/2007 | Miles, Jr. | 239/672 |
| 7,370,818 | B2 * | 5/2008 | Ward et al. | 239/662 |

FOREIGN PATENT DOCUMENTS

| | | |
|---|---|---|
| JP | 05-094308 U | 12/1993 |
| KR | 10-1999-0024190 | 3/1999 |
| KR | 10-2004-0018671 | 3/2004 |

* cited by examiner

*Primary Examiner* — Len Tran
*Assistant Examiner* — James Hogan
(74) *Attorney, Agent, or Firm* — Dickinson Wright PLLC

(57) ABSTRACT

A material spreader having a hopper for containing material and a liquid tank containing liquid adjacent the hopper. The liquid tank has a passage extending from the hopper through the tank with a discharge opening. An auger extends through the hopper and passage for conveying material to the outlet for delivery to a spinner for distributing the material. At least one nozzle is mounted in the passage for spraying liquid onto the material as it is being conveyed through the passage.

34 Claims, 6 Drawing Sheets

MATERIAL SPREADER WITH INTEGRATED WETTING SYSTEM

CROSS-REFERENCE TO RELATED APPLICATIONS

This application claims the benefit of U.S. Provisional Patent Application Ser. No. 60/951,286 for a MATERIAL SPREADER WITH ENCLOSED WETTING SYSTEM, filed on Jul. 23, 2007, which is hereby incorporated by reference in its entirety.

STATEMENT REGARDING FEDERALLY SPONSORED RESEARCH

NONE

TECHNICAL FIELD

This invention relates generally to material spreaders, such as for example salt, sand, or salt and sand mixtures and, more particularly, to pre-wetting systems to pre-wet the material prior to it being spread onto a surface by the spreader equipment. It should be understood by those of ordinary skill in the art that the spreader of the present invention can also be used to spread dry material as well as wet material.

BACKGROUND OF THE INVENTION

Pre-wetting is the process of for example spraying deicing salt with a solution of liquid chemical before spreading the salt on a roadway. Pre-wetting the salt helps it work more effectively as a deicing agent for two reasons: Firsts wet salt clings to the road instead of bouncing off or being swept off by traffic. The result is that less salt is spread, saving money and minimizing the threat to the environment. Second, to be effective as a deicing agent, salt requires moisture. Moisture dissolves the salt, releasing heat and thereby melting the ice and snow, as well as breaking the ice-road bond. When temperatures drop below freezing there is no moisture on the road, and salt alone is ineffective. Pre-wetting the salt ensures that there will be enough moisture to facilitate the melting process. There are several chemicals used to pre-wet salt. The most inexpensive is the use of sodium chloride and water or salt brine which is a salt and water solution. See Semisequicentennial Transportation Conference Proceedings, May 1996, Iowa State University.

Since brine is what actually melts snow and ice, solid rock salt must first create brine before it goes to work. In the absence of heat, sunlight, friction, or in low available moisture levels, solid salt is slower to go to brine and then to work. Road salt (sodium chloride) has an effective temperature range above 20-25 degrees Fahrenheit. When temperatures drop to around 10 degrees F. or below, road salt has significantly reduced melting capacity. The addition of a liquid chemical to salt enhances its ability to provide safe levels of service by increasing the speed at which salt creates brine to melt snow or ice. Greater chloride efficiency is achieved when liquid chemicals are added to salt by lowering the "effective" temperature range of the salt.

There are many methods in place to pre-wet salt. Some agencies have sprayed liquid chemicals over loads in the spreaders creating a "hot load". This method does not uniformly coat all the salt in the spreader and often runs out the back. Some liquid chemicals can "fuse" the salt in the spreader if not emptied, thereby adding to maintenance headaches and clumps in the salt. Others apply a given amount to each loader bucket prior to loading in the spreader. This method is somewhat more effective than direct over the top applications. See Mark Cornwell, Ice Control Engineering, Syntech Products Corporation.

Another method of wetting the salt is to spray the salt with sodium chloride or salt brine as it is leaving the spreader. Nozzles are mounted adjacent the spinner and spray the salt as it is being spread onto the surface. The problem with pre-wetting in this way is over spraying of the chemical which is uneconomical and provides an uneven application of the pre-wetting solution to the salt which results in the salt bouncing off the surface and the salt not being effective to melt the snow and ice. Additionally, there is the problem of evaporation and drifting of product which are corrosive when put into the air.

SUMMARY OF THE INVENTION

In general terms, this invention provides either a wet or dry spreading system. The pre-wetting system sprays a liquid, such as for example sodium chloride, salt brine, water or any other suitable liquid onto the material within a pre-wetting channel or passage just before it is presented to the spinner. In this way, the material is pre-wetted in a controlled environment eliminating over spray and drifting into the atmosphere allowing an even distribution of liquid to the material. Because of the passage, the application of liquid can be carefully controlled.

In the disclosed embodiment, a liquid tank is either integrally joined to a hopper or attached to a hopper. The tank has a passage or channel, a tubular passage is disclosed, which extends through the lower portion of the tank. The passage is coaxially aligned with the exit of the hopper and has a discharge opening that opens onto a chute that directs the pre-wetted material to the spinner. In the disclosed embodiment, a longitudinal auger extends through the hopper and the passage to drive the material to the chute. The tank has a pump that draws liquid from the tank and pumps it to nozzles spaced along the passage. These nozzles spray the material as it is rotated and moved through the passage by the auger to present uniformly pre-wetted material to the spinner.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

Figure 1:
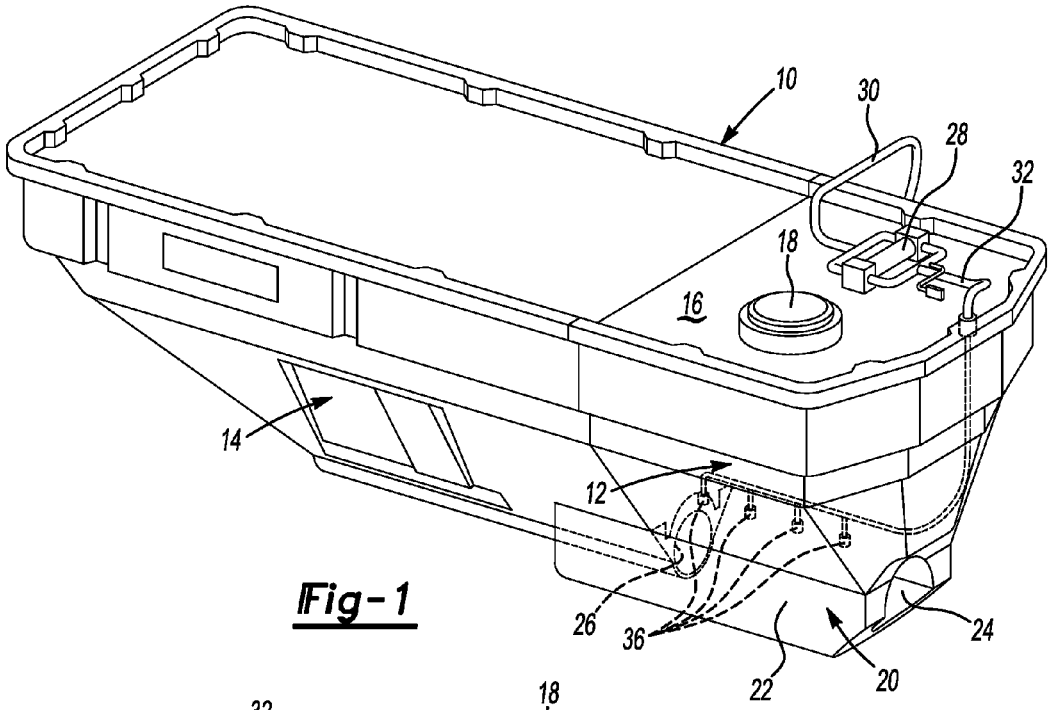
FIG. 1 is a perspective view of the hopper and tank of the present invention.

With reference to FIG. 1, the spreader and wetting system of the present invention is shown generally at 10. The system includes a wetting assembly 12 mounted to or integrally formed with a hopper 14.

The wetting assembly 12 includes a tank 16 which has a fill opening closed by a cap 18. In use, material, such as salt, sand, salt and sand mixtures, etc. is added to the hopper 14 and liquid, such as for example salt brine, water, etc. is added to the tank 16. If salt brine is intended to be used the salt brine mixture is the typical mixture used in the application of salt brine as known by those of ordinary skill in the art. Formed near the base of the tank 16 is a passage 20. In the disclosed embodiment, the passage 20 is a tube 22 with a discharge opening 24 that adjoins a feed chute 62 (see FIGS. 5 and 6) and an entrance 26 that adjoins and is coaxially aligned with the exit of the hopper 14.

Figure 4:
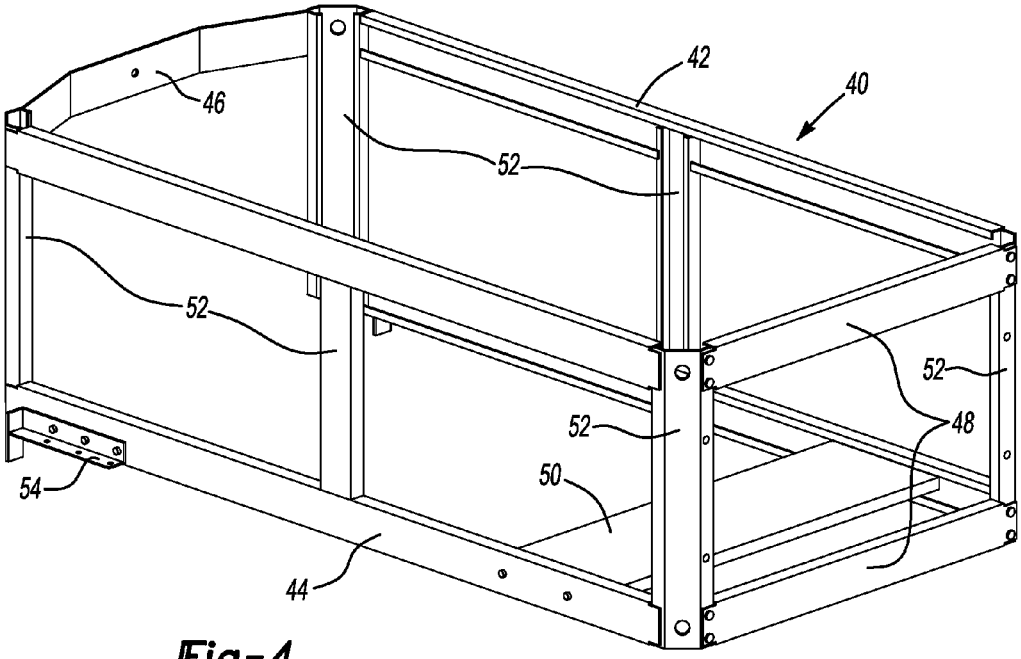
FIG. 4 is a mounting assembly for mounting the hopper and tank in a vehicle.
Figure 7:
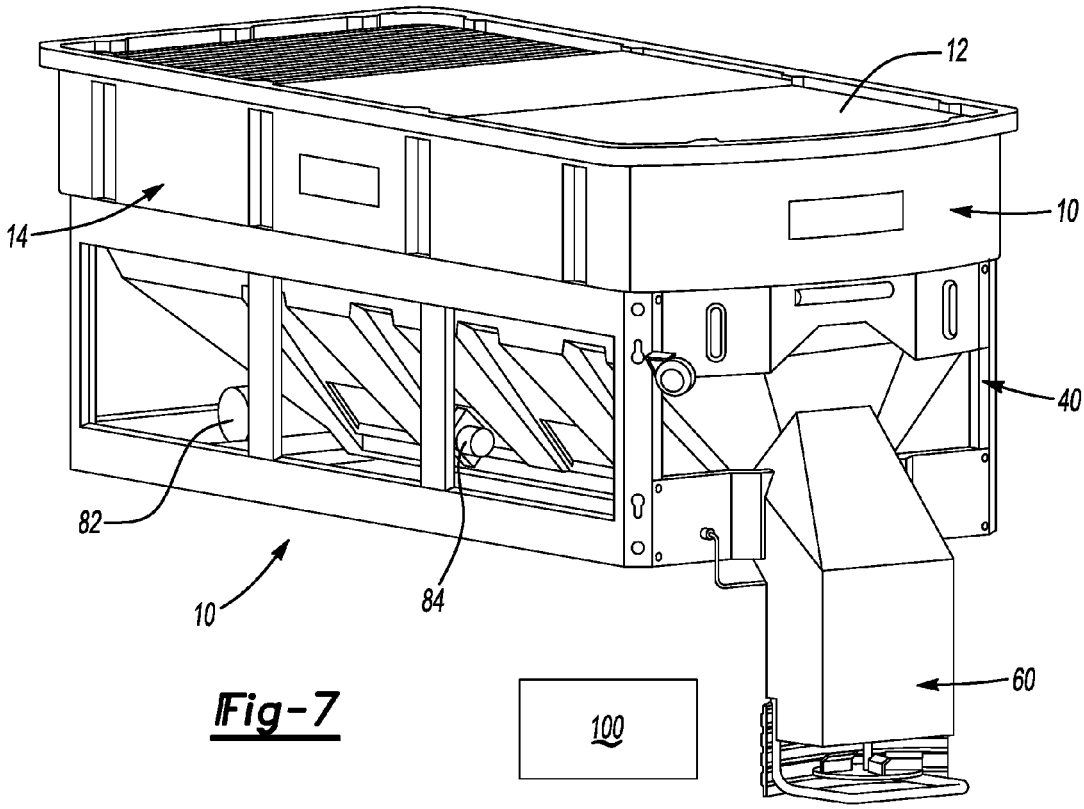
FIG. 7 is a perspective view of the hopper and tank mounted in the mounting assembly.

A pump 28 is mounted to the tank 16. As disclosed, the pump 28 is mounted to the top of the tank 16. It will be understood by those of ordinary skill in the art that the pump 28 could be mounted anywhere on the spreader and wetting system 10 or the frame 40 which is shown in FIGS. 4 and 7. The pump 28 has an input line 30 that draws liquid from the tank 16 and an output line 32 that feeds liquid to a manifold 34 that has a series of spray nozzles 36. See FIG. 2. The spray nozzles 36 are mounted inside the passage 20 to spray the material as it is moved through the passage 20. By spraying in the passage 20, there is less dispersion of the atomized liquid making the system more efficient.

Figure 2:
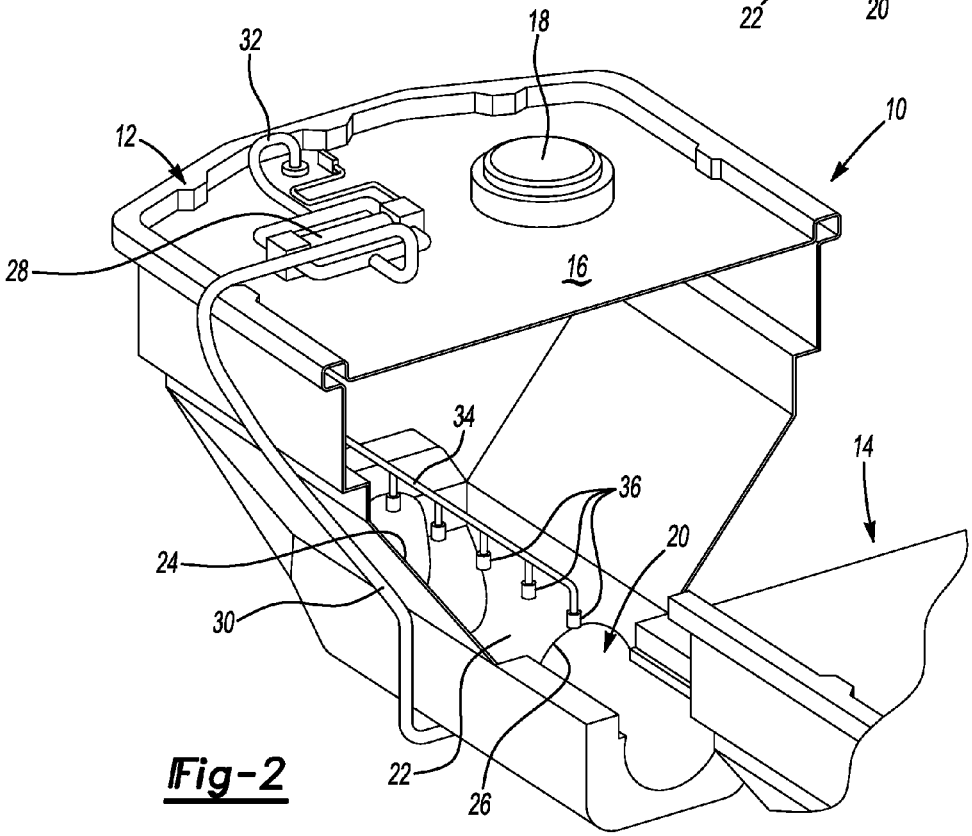
FIG. 2 is a perspective view of the tank of the present invention.
Figure 3:
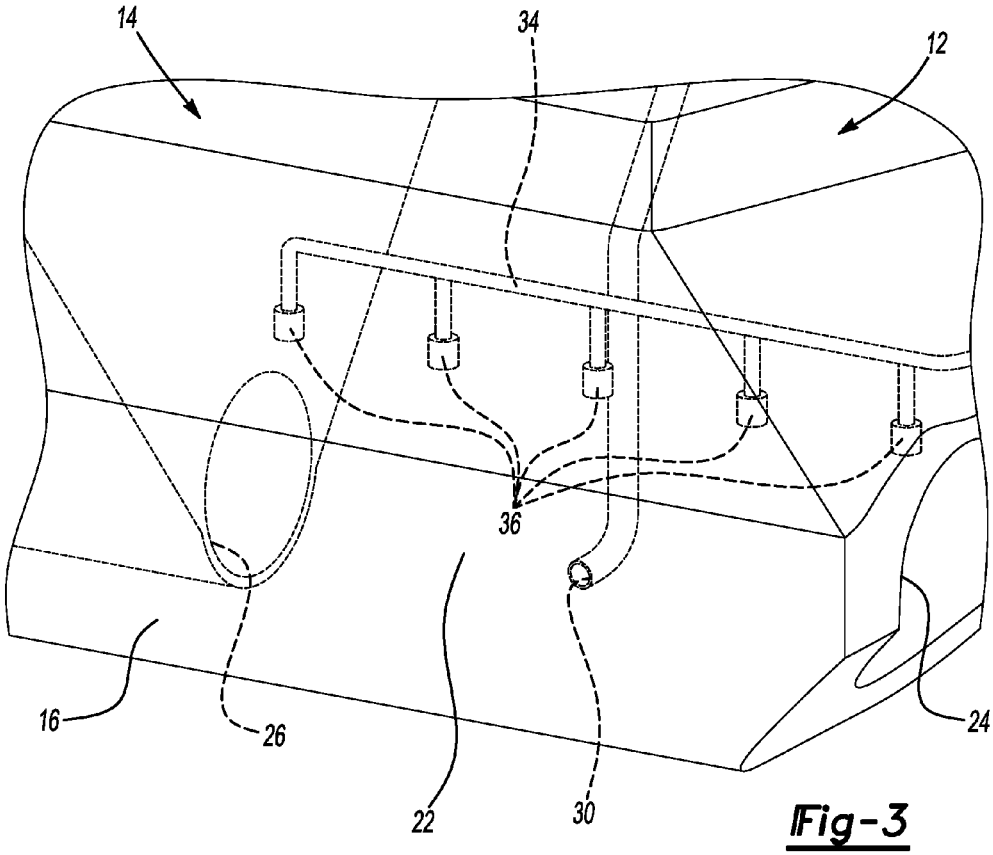
FIG. 3 is a perspective view of the chamber of the present invention.

The line 30 is connected to the bottom of the tank 16 as disclosed in FIGS. 2 and 3. As can be seen, the tank 16 extends below the passage 20. Although not shown, the passage 20 can have openings or return passages to allow liquid to return to the tank 16 during the spraying process. It should be understood that return openings or return passages are not required, but could be incorporated into the passage 20. The line 32 extends from the pump 28 into the tank and connects to the manifold 34 to supply liquid to the nozzles 36.

With reference to FIGS. 4 and 7, the mounting frame 40 of the present invention will be described. The mounting frame 40 is used to mount the hopper 14 and tank 16 in the bed of a vehicle, such as for example a pick up truck, or flat bed truck. The frame includes a top rail 42, bottom rail 44, top rear rail 46 and end rails 48. The rails are connected by vertical rails 52. A bottom support 50 completes the frame 40. As shown in FIG. 7, the hopper 14 and tank 16 fit within and are supported by the frame 40. In the disclosed embodiment, mounting brackets 54 are used to mount the frame 40 in the bed of the vehicle. As will be appreciated, the frame 40 is only an example of a mounting frame that can be used, in addition, for example, a plastic frame could be used or the hopper 14 and tank 12 could be integrally molded with supports.

Figure 5:
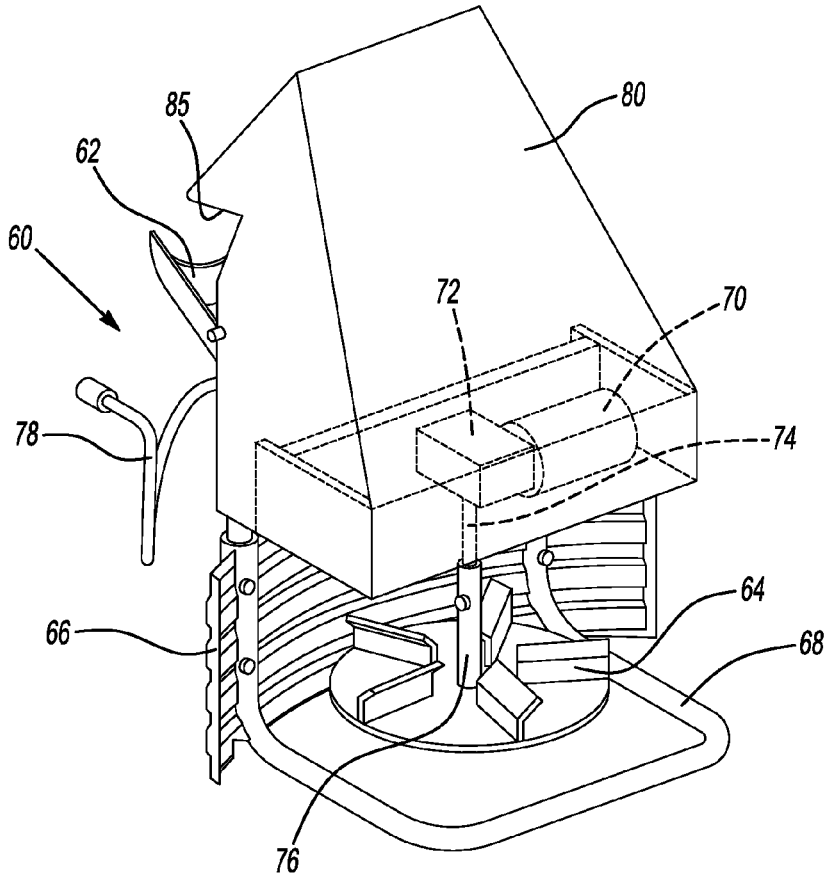
FIG. 5 is a chute and spreader assembly of the present invention.
Figure 6:
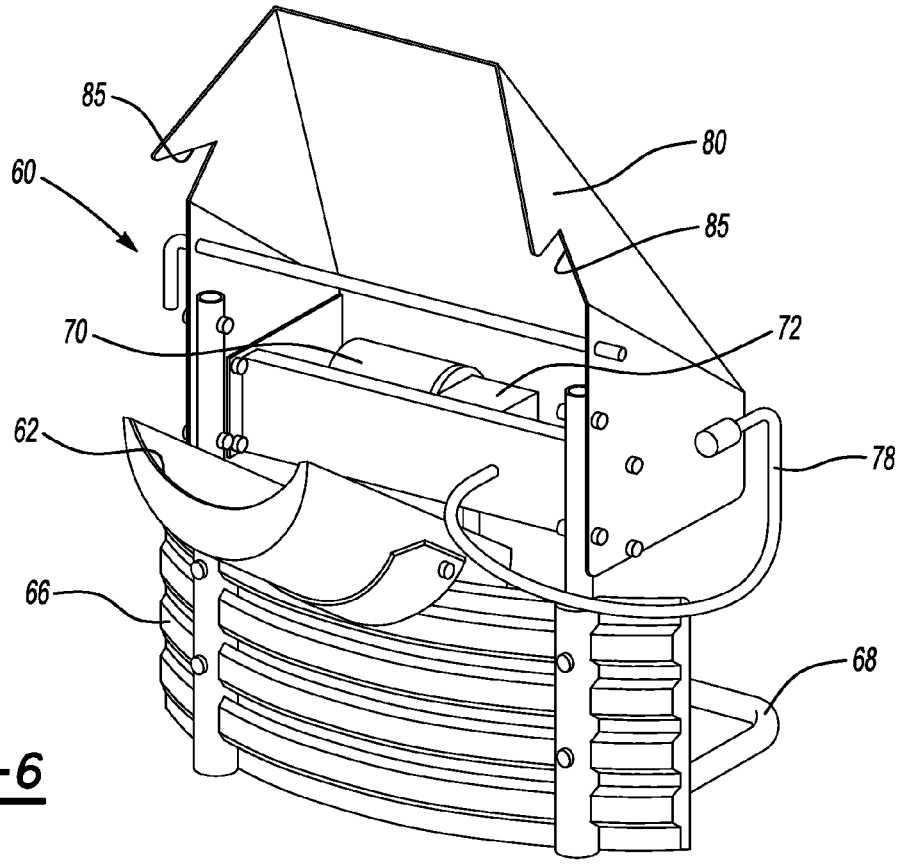
FIG. 6 is rear perspective view of the chute and spreader assembly of the present invention.

With reference to FIGS. 5 and 6, an embodiment of the spinner assembly of the present invention is shown generally at 60. The spinner assembly 60 includes a feed chute 62 which adjoins the discharge opening 24 of the passage 20. The chute 62 directs material from the exit 24 to the spinner 64. The spinner 64 is shielded from the tank 16 and vehicle by a deflector shield 66. A support frame 68 supports the chute 20, deflector 66 and a motor 70 and transmission 72. A housing or shroud 80 covers these parts. As shown, the shroud 80 includes notches 85 to allow the spinner assembly 60 to be easily mounted and removed from the frame 40. A drive shaft 74 extends from the transmission 72. The spinner 64 is coupled to the drive shaft 74 through a coupling 76. The motor 70 includes a power cord 78 to connect to the vehicle power supply, which is not shown.

Figure 8:
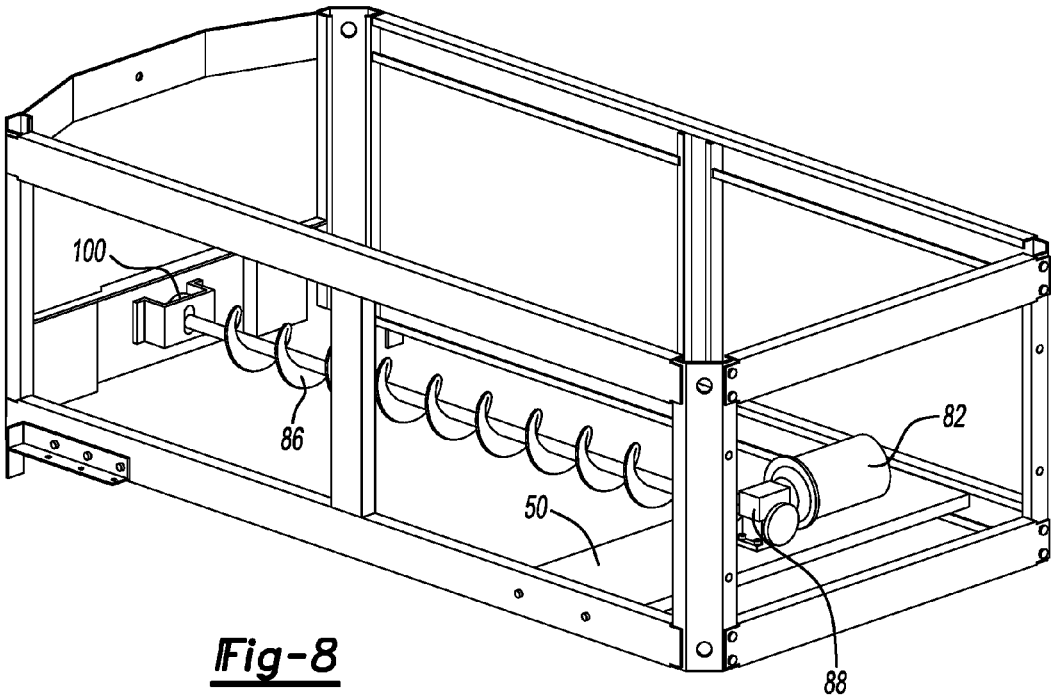
FIG. 8 is a perspective view of the auger of the present invention.
Figure 9:
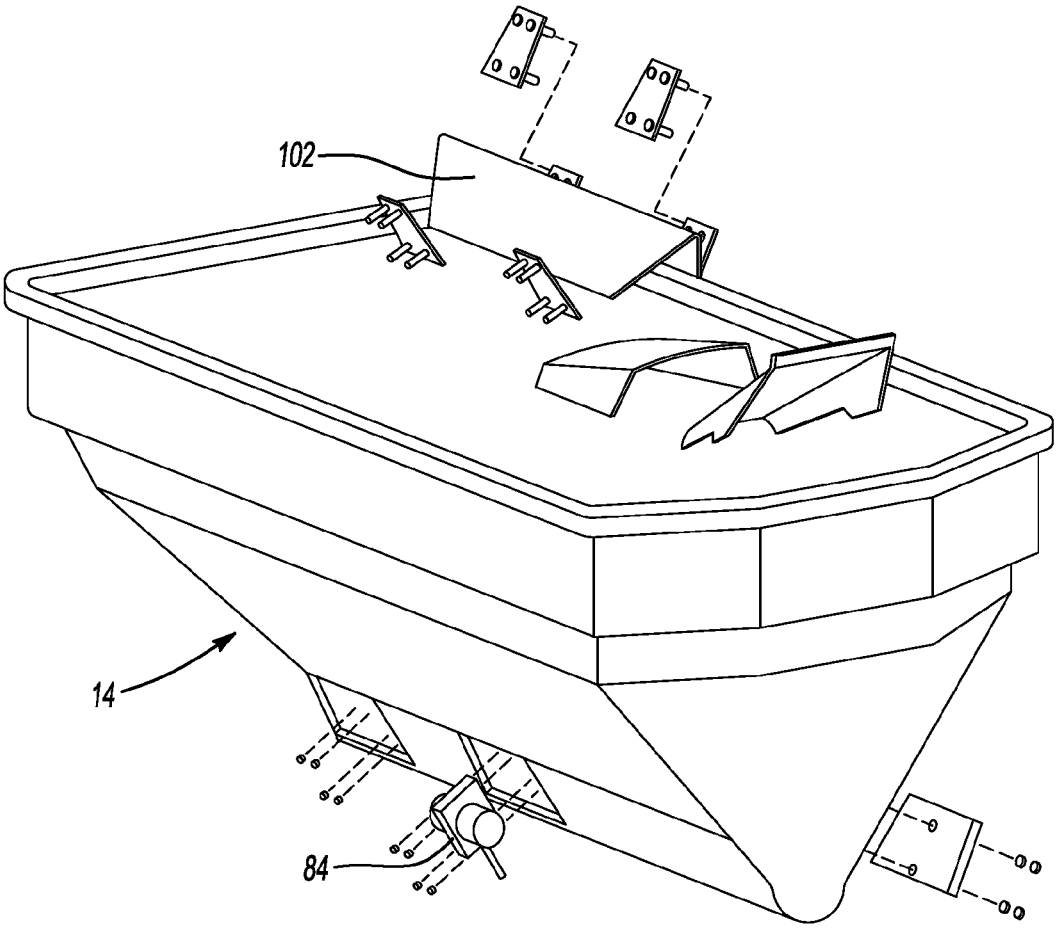
FIG. 9 is a perspective partially exploded view of the hopper 14.

With reference to FIGS. 7, 8 and 9 an embodiment of the spreader and wetting assembly 10 of the present invention is illustrated. The assembly 10 has an auger drive 82 that powers a longitudinal auger shown at 86, see FIG. 8. The auger 86 extends through the hopper 14 and the passage 20 of the tank 16. As will be appreciated by those of ordinary skill in the art, the auger drive 82 rotates the auger 86 to rotate and drive material from the hopper 14, through the passage 20 to the chute 62. A vibrator 84 is also illustrated. In the preferred embodiment, the vibrator 84 is connected to a v-shaped plate 102 mounted over the auger 86. See FIG. 9. The vibrator 84 vibrates the plate 102 to ensure that the auger continually receives material from the hopper. Those of ordinary skill in the art will understand the vibrator 84 and plate 102 as disclosed and described in numerous patents owned by Trynex, the assignee of the present invention, which are included herein by reference.

With reference to FIG. 8, auger 86 is illustrated. Auger 86 extends between a transmission assembly 88 and a bearing 100. In the disclosed embodiment, the auger drive 82 and transmission are mounted on the bottom support 50.

Figure 10:
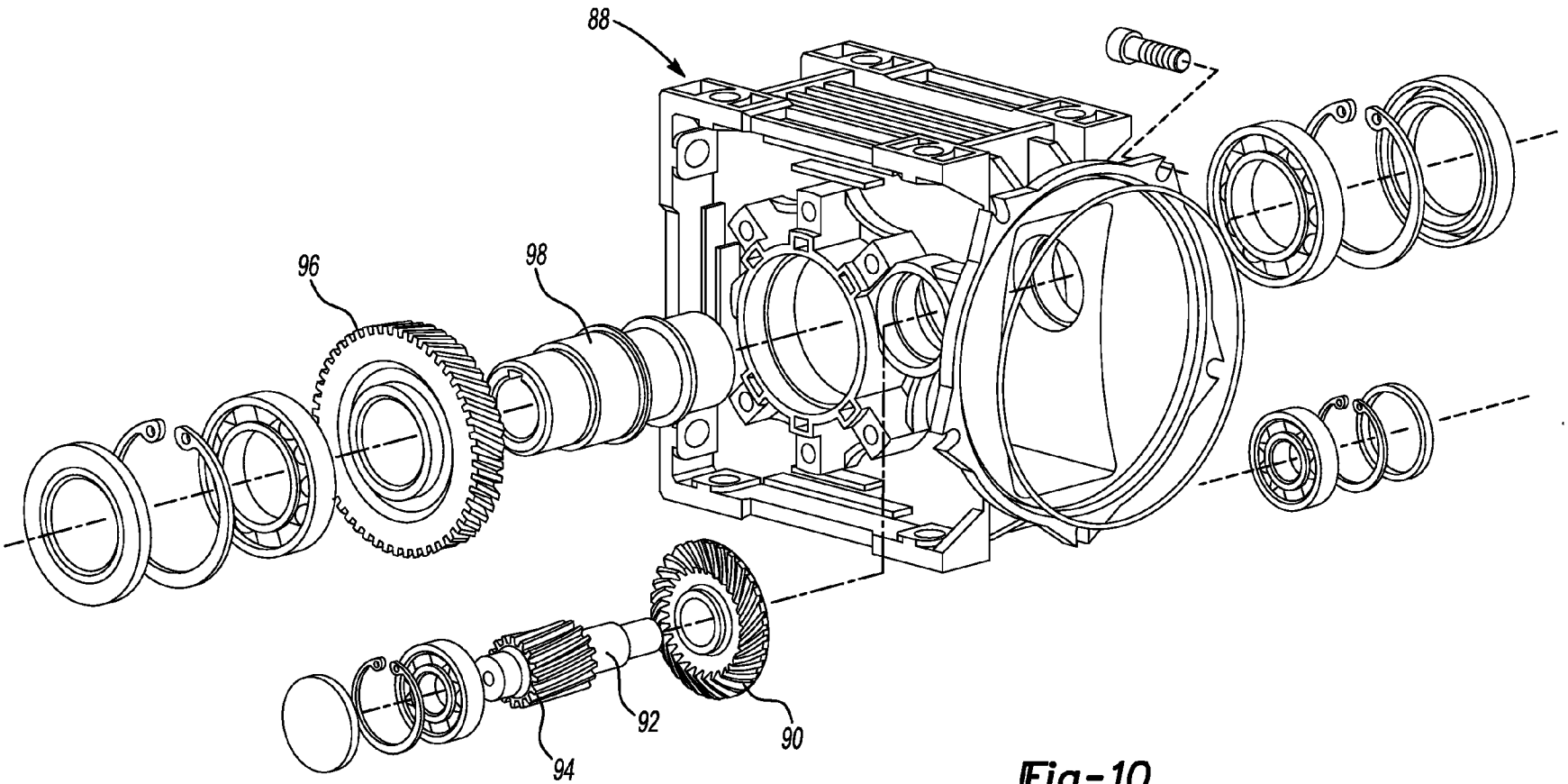
FIG. 10 is an exploded view of the helical bevel geared transmission of the present invention.

With reference to FIG. 10, an exploded view of transmission assembly 88 is illustrated. The transmission 88 illustrated in FIG. 10 is a helical bevel geared transmission having a high efficiency bevel gear 90. With the disclosed transmission 88, the amps required to turn the auger 86 when subjected to full loads of material, for example loads over 2 yards, is cut in half when compared to typical transmissions used with spreaders. With a typical spreader transmission, the amperage can go up to over 120 amps. With the transmission 88, the amperage pulled is around 60 amps, allowing typical vehicle electric systems to easily handle the required amperage draw.

In use, the motor 82 has a mating gear (not shown) which mates with helical bevel gear 90. Bevel gear 90 is mounted on input shaft 92 which has a worm gear 94. The worm gear 94 mates with a driver gear 96 mounted on output shaft 98. Output shaft 98 is operatively connected to the auger 86. If desired, a helical bevel geared transmission 88 can be used as the transmission 72 to drive the spinner 64.

A controller unit 100 controls the auger 86, spreader assembly 60, and the pump 28 and the feed rate of each. One feature of the controller 100 is the ability to monitor the auger feed rate and automatically adjust the amount of liquid supplied to the auger 86. The controller 100 will supply a certain amount of liquid for a given auger speed. The controller 100 will also allow manual supply of liquid to the auger 86 in the passage 20 as well. In the preferred embodiment, the controller 100 is mounted within the vehicle.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. A material spreader comprising:

a hopper for containing material, said hopper having an outlet for discharging material from said hopper;

a liquid tank mounted adjacent to the hopper, said tank including a passage extending through said tank, said passage having an entrance coaxially aligned with said outlet of said hopper and a discharge opening, said passage is separated from said liquid in said liquid tank, an enclosure to enclose said passage to separate said passage from said liquid tank, said enclosure extends through said liquid tank whereby said liquid is adapted to surround said enclosure;

an auger extending through said hopper and said passage for conveying material from said hopper and through said passage and out of said discharge opening;

at least one nozzle mounted within said passage and a pump operatively connected between said liquid tank and said nozzle;

said nozzle spraying liquid upon said material as said salt is conveyed through said passage;

a spinner mounted adjacent said discharge opening for spreading said material;

an electric drive motor, a transmission operatively connected to said drive motor and a material spreading disc coupled to said transmission, said transmission includes a helical bevel gear assembly requiring low amperage draw from said drive motor.

2. The material spreader of claim 1, wherein said hopper and said tank are joined together to form a unitary assembly.

3. The material spreader of claim 1, wherein said hopper and tank are integrally formed.

4. The material spreader of claim 1, wherein said pump has a pump inlet line operatively coupled to said liquid tank and a pump outlet line operatively coupled to said at least one nozzle.

5. The material spreader of claim 1, wherein said enclosure is a tube extending from said entrance to said discharge opening.

6. The material spreader of claim 1, wherein said pump has a pump inlet line operatively coupled to said liquid tank below said enclosure.

7. The material spreader of claim 1, further including an electric drive motor operatively coupled to a transmission which is operatively coupled to said auger, said transmission includes a helical bevel gear assembly requiring relatively low amperage draw from said drive motor.

8. The material spreader of claim 7, wherein said auger drive motor has a mating gear operatively coupled to said helical bevel gear, said helical bevel gear is mounted upon an input shaft, a worm gear mounted upon said input shaft spaced from said helical bevel gear, an output shaft operatively coupled to said auger, said output shaft includes a driver gear operatively coupled to said worm gear.

9. The material spreader of claim 1, further including a mounting frame for mounting said material spreader to a vehicle.

10. The material spreader of claim 1, wherein said material is salt.

11. The material spreader of claim 1, wherein said material is a mixture of salt and sand.

12. The material spreader of claim 1, wherein said material is sand.

13. The material spreader of claim 1, wherein said liquid is salt brine.

14. The material spreader of claim 1, wherein said liquid is water.

15. A material spreader comprising: a hopper for containing material, said hopper having an outlet for discharging material from said hopper;

a liquid tank mounted adjacent to the hopper, said tank including a passage extending through said tank, said passage having an entrance coaxially aligned with said outlet of said hopper and a discharge opening;

an auger extending through said hopper and said passage for conveying material from said hopper and through said passage and out of said discharge opening;

a spinner mounted adjacent said discharge opening for spreading said material;

a manifold mounted longitudinally along said passage, and a plurality of nozzles mounted along the length of said manifold, a pump operatively connected between said liquid tank and said plurality of nozzles;

said plurality of nozzles spraying liquid upon said material as said material is conveyed through said passage.

16. The material spreader of claim 15, wherein said hopper and said tank are joined together to form a unitary assembly.

17. The material spreader of claim 15, wherein said hopper and tank are integrally formed.

18. The material spreader of claim 16, wherein said pump has a pump inlet line operatively coupled to said liquid tank and a pump outlet line operatively coupled to said at least one nozzle.

19. The material spreader of claim 15, wherein said passage is separated from said liquid in said liquid tank.

20. The material spreader of claim 19, further including an enclosure to enclose said passage to separate said passage from said liquid tank.

21. The material spreader of claim 20, wherein said enclosure is a tube extending from said entrance to said discharge opening.

22. The material spreader of claim 19, wherein said enclosure extends through said liquid tank whereby said liquid is adapted to surround said enclosure.

23. The material spreader of claim 22, wherein said pump has a pump inlet line operatively coupled to said liquid tank below said enclosure.

24. The material spreader of claim 15, wherein said spreader includes an electric drive motor, a transmission operatively connected to said drive motor and a salt spreading disc coupled to said transmission.

25. The material spreader of claim 24, wherein said transmission includes a helical bevel gear assembly requiring low amperage draw from said drive motor.

26. The material spreader of claim 15, further including an electric drive motor operatively coupled to a transmission which is operatively coupled to said auger, said transmission includes a helical bevel gear assembly requiring relatively low amperage draw from said drive motor.

27. The material spreader of claim 15, wherein said drive motor has a mating gear operatively coupled to said helical bevel gear, said helical bevel gear is mounted upon an input shaft, a worm gear mounted upon said input shaft spaced from said helical bevel gear, an output shaft operatively coupled to said auger, said output shaft includes a driver gear operatively coupled to said worm gear.

28. The material spreader of claim 15, further including a mounting frame for mounting said material spreader to a vehicle.

29. The material spreader of claim 15, wherein said material is salt.

30. The material spreader of claim 15, wherein said material is a mixture of salt and sand.

31. The material spreader of claim 15, wherein said material is sand.

32. The material spreader of claim 15, wherein said liquid is salt brine.

33. The material spreader of claim 15, wherein said liquid is water.

34. A material spreader comprising: a hopper for containing material, said hopper having an outlet for discharging material from said hopper;

a liquid tank mounted adjacent to the hopper, said tank including a passage extending through said tank, said passage having an entrance coaxially aligned with said outlet of said hopper and a discharge opening;

an auger extending through said hopper and said passage for conveying material from said hopper and through said passage and out of said discharge opening;

a manifold mounted longitudinally along said passage, and a plurality of nozzles mounted along the length of said manifold;

a pump operatively connected between said liquid tank and said plurality of nozzles; said plurality of nozzles spraying liquid upon said material as said material is conveyed through said passage;

a spinner mounted adjacent said discharge opening for spreading said material; an electric drive motor, a transmission operatively connected to said drive motor and a salt spreading disc coupled to said transmission, said transmission includes a helical bevel gear assembly requiring low amperage draw from said drive motor.

* * * * *

UNITED STATES PATENT AND TRADEMARK OFFICE

CERTIFICATE OF CORRECTION

PATENT NO. : 8,025,245 B2
APPLICATION NO. : 12/177955
DATED : September 27, 2011
INVENTOR(S) : Charles Truan et al.

It is certified that error appears in the above-identified patent and that said Letters Patent is hereby corrected as shown below:

IN THE SPECIFICATIONS:

Column 1, Line 33: “Firsts” should read -- First --.

IN THE CLAIMS:

Column 6, Line 17, Claim 18: “16” should read -- 15 --.

Signed and Sealed this
Thirteenth Day of March, 2012

David J. Kappos

David J. Kappos
*Director of the United States Patent and Trademark Office*